US005170511A

United States Patent [19]

Kamata

[11] Patent Number: 5,170,511

[45] Date of Patent: Dec. 15, 1992

[54] AIR INTAKE DEVICE IN HELMET

[75] Inventor: Eitaro Kamata, Tokyo, Japan

[73] Assignee: Shoei Kako Kabushiki Kaisha, Tokyo, Japan

[21] Appl. No.: 805,175

[22] Filed: Dec. 11, 1991

[30] Foreign Application Priority Data

May 31, 1991 [JP] Japan ..... 3-040723[U]

[51] Int. Cl.[5] ..... A42B 1/08

[52] U.S. Cl. ..... 2/424; 2/171.3

[58] Field of Search ..... 2/410, 411, 422, 424, 2/425, 171.3

[56] References Cited

U.S. PATENT DOCUMENTS

| | | | |
|---|---|---|---|
| 4,115,874 | 9/1978 | Hasegawa | 2/425 |
| 4,731,885 | 3/1988 | Nava | 2/424 |
| 5,058,212 | 10/1991 | Kamata | 2/424 |
| 5,093,938 | 3/1992 | Kamata | 2/424 |

FOREIGN PATENT DOCUMENTS

| | | | |
|---|---|---|---|
| 83113 | 12/1975 | Taiwan . | |
| 83114 | 12/1975 | Taiwan . | |
| 2198925 | 6/1988 | United Kingdom | 2/424 |

*Primary Examiner*—Werner H. Schroeder
*Assistant Examiner*—Michael A. Neas
*Attorney, Agent, or Firm*—Armstrong & Kubovcik

[57] ABSTRACT

In an air intake device in a helmet, an air introducing unit is comprised of a base plate, a cover, and a shutter contained in a shutter chamber defined between the base plate and cover, and the base plate is detachably secured to a mounting plate within a cap body at a point facing to an inlet hole in the cover. If an air intake device mounted to the cap body to ventilate the inside of the cap body becomes dirty due to the entering of dusts, muds or the like the shutter and the like of the air intake device can be removed and readily cleaned by washing with water or the like.

4 Claims, 7 Drawing Sheets

AIR INTAKE DEVICE IN HELMET

BACKGROUND OF THE INVENTION

1. Field of the Invention

The field of the present invention is air intake devices in helmets of the type primarily used by drivers or passengers of automobiles, motorcycles or the like, wherein the air intake device is designed so as to introduce airstream to the interior of a cap body to provide ventilation and to intercept the introduction of the airstream, and more particularly, improvements of air intake devices of the type including a shutter provided on a front surface of the cap body for providing the introduction and interception of an open air into an air introducing hole opened into the front surface.

2. Description of the Prior Art

Such an air intake device has already been known, for example, as disclosed in Japanese Utility Model Publication Kokoku No. 7844/90. In the prior art air intake device, a cover which supports the shutter is secured to the front surface of the cap body with an adhesive.

In a helmet for use when riding on a vehicle, the inner surface of the cover and the shutter may become dirty due to the entering of dusts, muds and the like, depending upon conditions of use thereof. In this case, if the cover is undetachably secured to the cap body, it is extremely difficult to clean the shutter and the like.

SUMMARY OF THE INVENTION

Accordingly, it is an object of the present invention to provide an air intake device of the type described above which is designed such that the shutter and the like can be removed from the cap body, and the shutter and the like can be readily cleaned.

To achieve the above object, according to the present invention, there is provided an air intake device in a helmet, including a shutter provided on a front surface of a cap body for providing the introduction and interception of the open air into an air introducing hole opened into the front surface of the cap body, comprising an air introducing unit which is comprised of a base plate, a cover bonded to the base plate to define a shutter chamber between the cover itself and the base plate, and a shutter contained in the shutter chamber, the cover including an inlet hole which is opened and closed by the shutter to communicate with the air introducing hole through a wind guide portion in the base plate upon opening of the shutter, the base plate being detachably secured to a mounting member within the cap body.

With the above construction, the air introducing unit can be removed form the cap body and therefore, can be cleaned to its inside by washing with water or the like, which is sanitary. Moreover, the entire air introducing unit is detachably mounted to the cap body and hence, reassembling after cleaning is extremely simple, and there is no fear of losing parts when they are reassembled.

The above and other objects, features and advantages of the invention will become apparent from a consideration of the following description of the preferred embodiments, taken in conjunction with the accompanying drawings.

BRIEF DESCRIPTION OF THE DRAWINGS

Drawings illustrate one embodiment of the present invention, wherein.

DESCRIPTION OF THE PREFERRED EMBODIMENTS

The present invention will now be described by way of a preferred embodiment in connection with the accompanying drawings.

Figure 1:
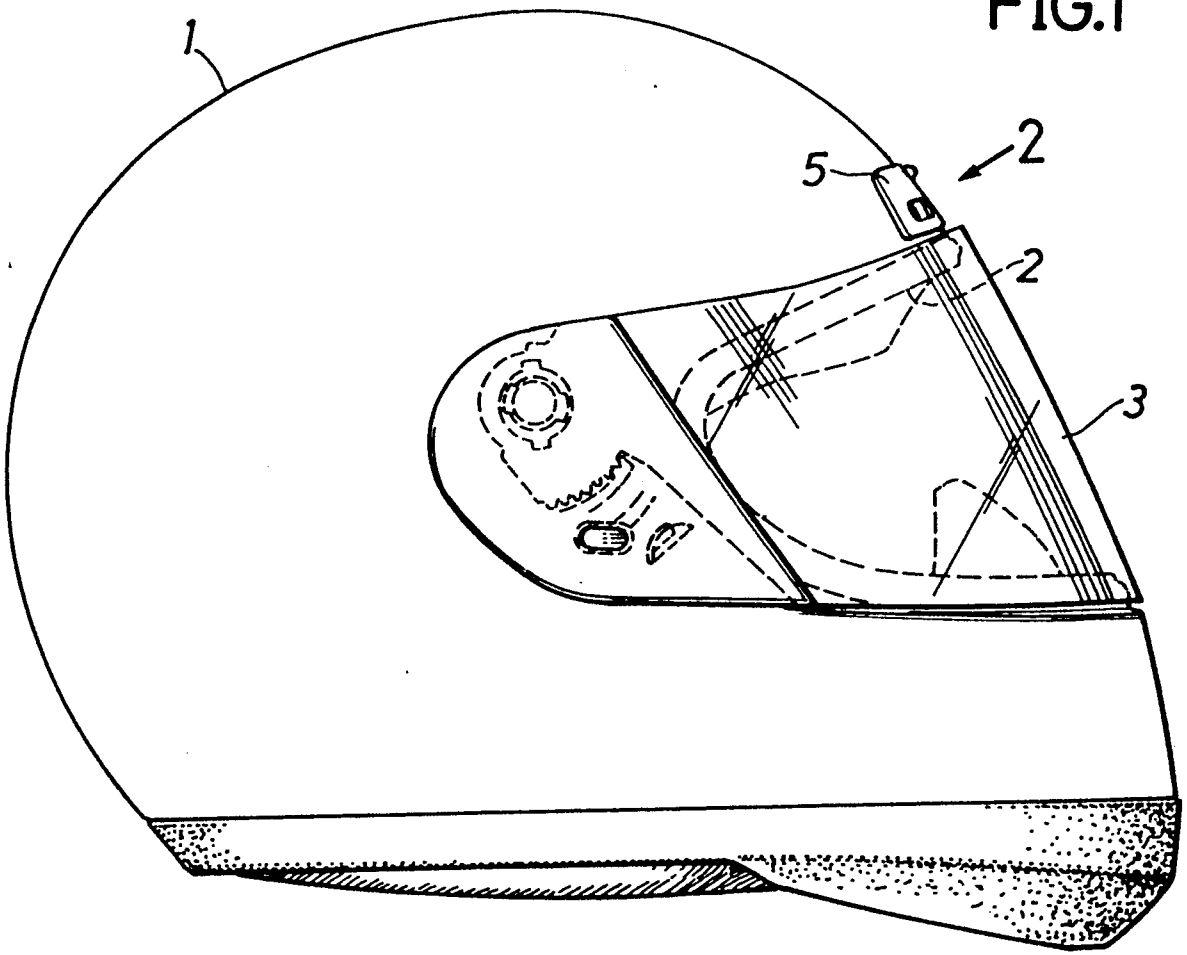
FIG. 1 is a side view of a helmet including an air intake device according to the embodiment of the present invention.

Referring first to FIG. 1, a cap body 1 of a helmet is formed into a full-face type having a chin covering portion immediately below a window 2 in a front surface and comprises a shield 3 for opening and closing the air window 2.

An air intake device 5 of the present invention is provided on the cap body 1 immediately above the window 2.

Figure 2:
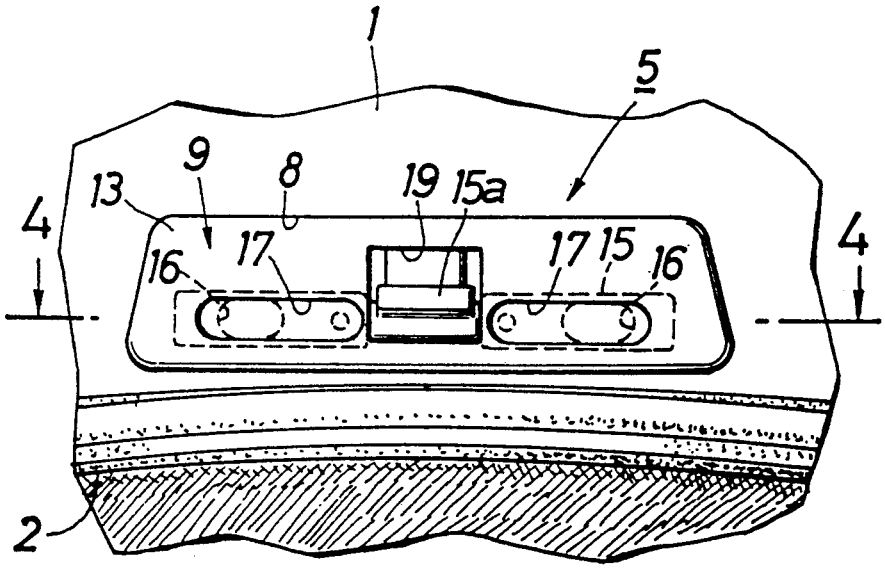
FIG. 2 is an enlarged front view of the air intake device with a shutter shown as being closed, taken along an arrow 2 in FIG. 1.
Figure 4:
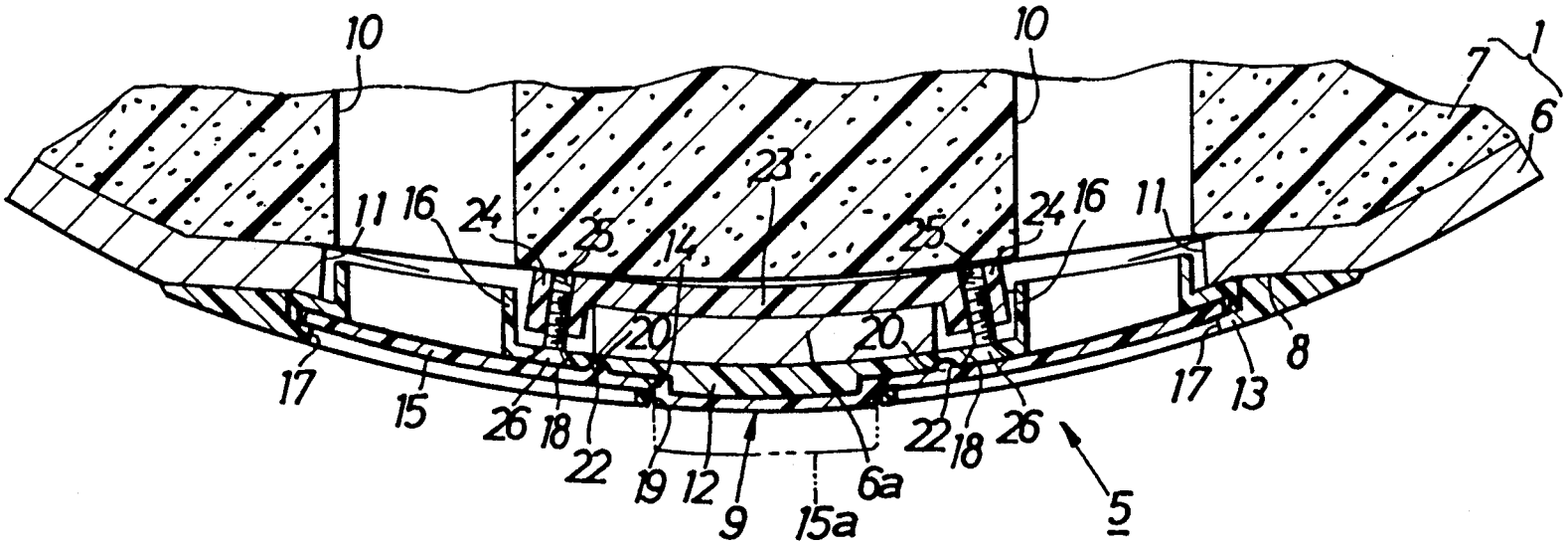
FIG. 4 is a sectional view taken along a line 4—4 in FIG. 2.
Figure 7:
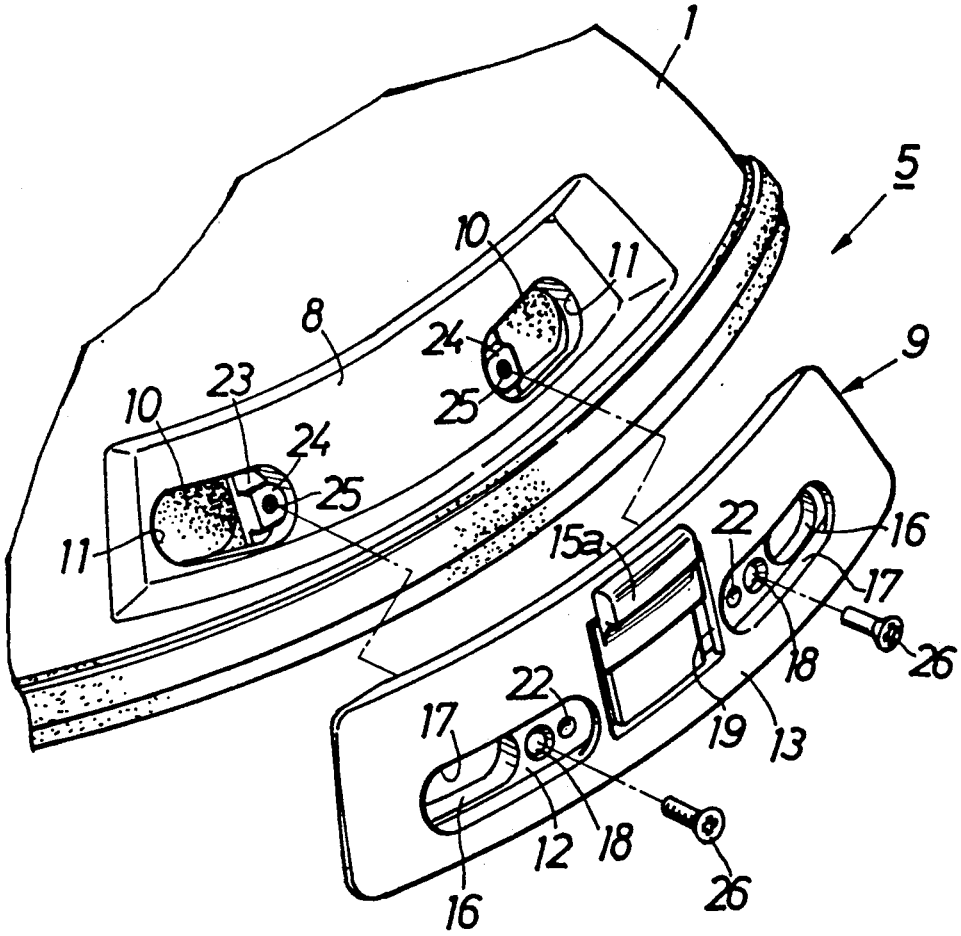
FIG. 7 is an exploded perspective view of the air intake device.

As shown in FIGS. 2, 4 and 7, a shallow recess 8 is provided in a shell 6 of the cap body 1 immediately above the window 2, and an air introducing unit 9 constituting a main body of the air intake device 5 is placed in the recess 8. A pair of air introducing holes 11, 11 are provided in the shell 6 at the recess 8 and connected to ventilating passages 10 in the cap body 1. Each of the air introducing holes 11 is formed into a laterally long elliptic shape.

The air introducing unit 9 is comprised of a base plate 12 placed on a bottom surface of the recess 8, a cover 13 bonded to the base plate 12 to define a flat chamber 14 between the cover 13 itself and a front surface of the base plate 12, and a plate-like shutter 15 vertically slidably received in the shutter chamber 14. These components are made of synthetic resin.

The base plate 12 is provided with wind guide tubes 16, 16 as a pair of left and right wind guide portions projected into the air introducing holes 11, 11, and a pair of left and right mounting holes 18, 18 adjacent the wind guide tubes 16, 16. The cover 13 is provided with a pair of left and right inlet bore 17, 17 which face the wind guide tubes 16, 16 and the mounting holes 18, 18, and an operating window 19 located between the inlet bores 17, 17. An operating knob **15*a* for the shutter 15 is disposed in the operating window 19. If the operating knob 15*a* is moved up and down, both the inlet bores 17, 17 can be concurrently opened and closed by the shutter 15**.

Figure 3:
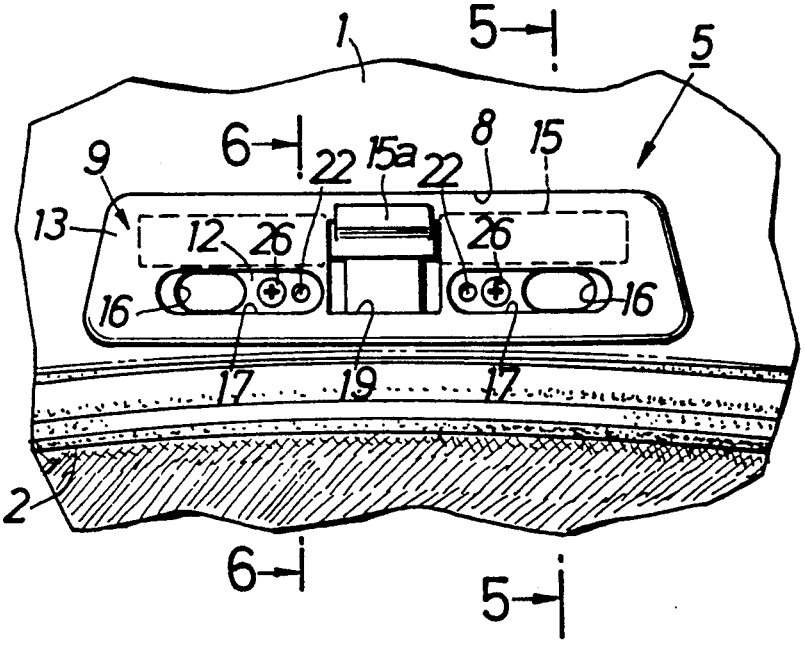
FIG. 3 is a front view similar to FIG. 2 but with the shutter shown as being opened.
Figure 5:
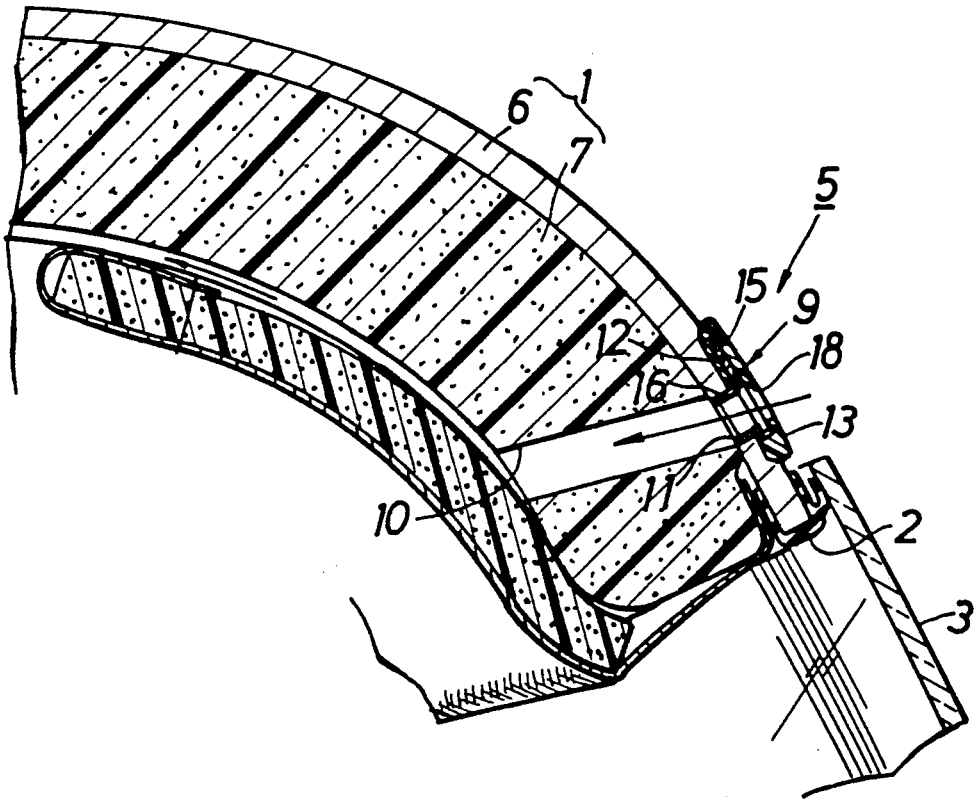
FIG. 5 is a sectional view taken along a line 5—5 in FIG. 3.

A closed state of the shutter 15 is shown in FIGS. 2 and 4, and an opened state thereof is shown in FIGS. 3 and 5. When the shutter 15 is opened, the open air is introduced through the inlet bores 17, the wind guide tubes 16 and the air introducing holes 11 into the ventilating passages 10 as shown by an arrow in FIG. 5 to contribute to the ventilation in the cap body.

Figure 6:
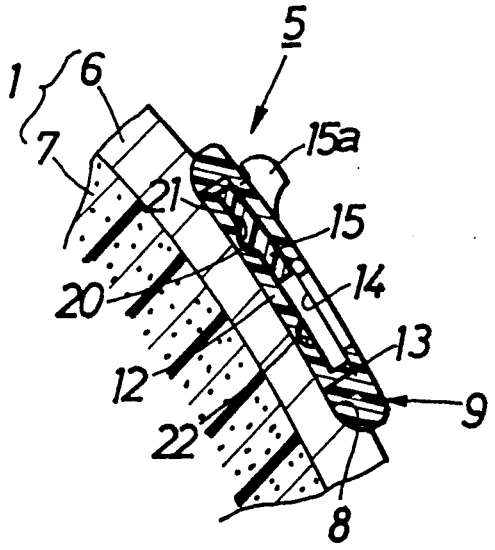
FIG. 6 is a sectional view taken along a line 6—6 in FIG. 3.

To retain the shutter 15 at its opened and closed positions, a small projection 20 on an inner surface of the shutter 15 is selectively brought into engagement with upper and lower notches 21, 22, respectively, in an outer surface of the base plate 12 by a resilient force of the shutter 15 itself, as shown in FIG. 6.

As shown in FIGS. 3, 4 and 7, a mounting plate 23 (mounting member) for supporting the air introducing unit 9 is inserted between the shell 6 an buffer liner 7 which constitute the cap body 1.

The mounting plate 23 includes a pair of left and right bosses 24, 24 projected into the air introducing holes 11, 11 and located in proximity to a partition wall 6*a* therebetween. The mounting plate 23 is movable vertically and laterally in a range of a clearance between the bosses 24, 24 and the air introducing holes 11, 11. The mounting plate 23 is prevented from being fallen off from the cap body 1 by abutment of the bosses 24, 24 against inner surfaces of the air introducing holes 11, 11.

The bosses 24, 24 are provided with threaded bores 25, 25, and machine screws 26, 26 are inserted through the mounting holes 18, 18. The air introducing unit 9 is detachably mounted to the cap body 1 by screwing the machine screws 26, 26 into the threaded bores 25, 25.

When mounting the air introducing unit 9, with the machine screws 25, 25 loosely screwed into the threaded bores 25, 25, the air introducing unit 9 is first aligned to a predetermined position in the recess 8. In this case, because the mounting plate 23 is movable longitudinally and laterally as described above, it follows to a position of the air introducing unit 9, so that the alignment of the air introducing unit 9 relative to the recess 8 is not obstructed in any way. If the machine screws 26, 26 are then tightened, both of the mounting plate 23 and the base plate 12 are secured to the shell 6. Therefore, the air introducing unit 9 can be correctly placed at a given position in the recess 8 without being affected by a fabrication error of each part.

If the shutter 15 is closed after securing, the machine screws 26, 26 can be hidden by the shutter 15, thereby satisfactorily keeping an ordinary appearance.

If the air introducing unit 9 becomes dirty due to the entering of dusts, muds and the like, the machine screws 26, 26 may be unscrewed to remove the air introducing unit 9 from the cap body 1. Then, the air introducing unit 9 may be washed with water, whereby the outer surface thereof as well as the inside of the unit 9 can be cleaned.

What is claimed is:

1. An air intake device in a helmet, including a shutter provided on a front surface of a cap body for providing the introduction and interception of the open air into an air introducing hole opened into the front surface of the cap body, comprising an air introducing unit which is comprised of a base plate, a cover bonded to said base plate to define a shutter chamber between the cover itself and said base plate, and a shutter container in said shutter chamber, said cover including an inlet hole which is opened and closed by said shutter to communicate with said air introducing hole through a wind guide portion in said base plate upon opening of said shutter, said base plate being detachably secured to a mounting member within said cap body.

2. An air intake device according to claim 1, wherein said base plate is provided with a mounting hole facing said inlet hole, and said base plate is detachably secured to said mounting member within said cap body by a machine screw inserted through the mounting hole.

3. An air intake device according to claim 1, wherein said cap body is comprised of a shell, and a buffer liner bonded to an inner surface of the shell, and said mounting member is movably clamped between said shell and said buffer liner to permit the positioning of said base plate with respect to a recess which is formed in an outer surface of said shell to receive said base plate.

4. An air intake device according to claim 3, wherein said mounting member includes a boss projected thereon and engageable into said air introducing hole to restrain the movement of said mounting member beyond an acceptable range.

* * * * *